US011322326B1

(12) United States Patent
Wu

(10) Patent No.: US 11,322,326 B1
(45) Date of Patent: May 3, 2022

(54) ELASTIC CONTACT PLATE STRUCTURE OF ELECTROMAGNETIC RELAY

(71) Applicant: SONG CHUAN PRECISION CO., LTD., New Taipei (TW)

(72) Inventor: Sung-Jen Wu, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 0 days.

(21) Appl. No.: 17/210,468

(22) Filed: Mar. 23, 2021

(51) Int. Cl.
*H01H 50/54* (2006.01)
*H01H 50/18* (2006.01)

(52) U.S. Cl.
CPC ..... *H01H 50/54* (2013.01); *H01H 50/18* (2013.01)

(58) Field of Classification Search
CPC ..... H01H 50/54; H01H 50/56
USPC ..... 335/83, 129
See application file for complete search history.

(56) References Cited

U.S. PATENT DOCUMENTS 6,046,661 A * 4/2000 Reger ..... H01H 50/643 335/185
7,710,224 B2 * 5/2010 Gruner ..... H01H 51/2281 335/130
8,203,403 B2 * 6/2012 Moeller ..... H01H 51/2227 335/78
9,916,954 B2 * 3/2018 Helmreich ..... H01H 50/58
2003/0112103 A1 * 6/2003 Schmelz ..... H01H 50/54 335/128
2009/0033446 A1 * 2/2009 Gruner ..... H01H 51/2281 335/129
2019/0013172 A1 * 1/2019 Hayashida ..... H01H 1/50

* cited by examiner

*Primary Examiner* — Alexander Talpalatski
(74) *Attorney, Agent, or Firm* — Fei-hung Yang

(57) ABSTRACT

An elastic contact plate structure of an electromagnetic relay includes at least one elastic plate assembly and at least one contact structure. The elastic plate assembly includes first, second, third and fourth plates sequentially stacked on one another, and first plate has a first convex arc bent portion with first mounting hole formed at an end; second plate has second convex arc bent portion with second mounting hole formed at an end. Third plate has third mounting hole formed at an end; fourth plate has fixed section, which has fourth mounting hole, and elastic section. Contact structure is passed and fixed into first, second, third, and fourth mounting hole. Therefore, the force receiving strength of elastic contact plate structure shows a positive linear change with the deformation, and the stability of connecting or disconnecting elastic contact plate structure is improved significantly, so as to achieve a better electrical performance.

19 Claims, 9 Drawing Sheets

ELASTIC CONTACT PLATE STRUCTURE OF ELECTROMAGNETIC RELAY

BACKGROUND

Technical Field

The present invention relates to the technical field of relays. More particularly, the present invention relates to an elastic contact plate structure applied to an electromagnetic relay.

Description of Related Art

Relay, also known as electric relay, is an electronic control component widely used in control circuits and it can be divided by its operating principle into various types of relays such as optical relays, electromagnetic relays, thermal relays, etc.

For example, the electromagnetic relay generally includes an electromagnetic coil, a movable contact and a fixed contact, and the fixed contact is externally coupled to a control circuit, wherein after the electromagnetic coil is electrically conducted, the movable contact is displaced by the electromagnetism of the electromagnetic coil, so as to achieve the effect of turning on or shutting off the electric power. In general, a movable contact is installed on an elastic movable plate for driving the movable contact to move in order to electrically conduct or disconnect a fixed contact. In some models of relays, the elastic movable plate is designed with a three-plate structure when taking the moving requirements into consideration. The aforementioned elastic movable plate structure includes three plates and a multiple of through holes formed on the plates to facilitate the installation of the contact structure. Although such elastic movable plate has a better moving performance than that of a single plate, the rigidity is too high, thus leading to a poor elasticity and an unstable contact strength, and the relay will produce high temperature or unstable resistance due to the incomplete contact, or even will be broken, cracked, or unrecoverable due to a large deformation occurred instantly.

SUMMARY

Therefore, it is a primary objective of the present invention to provide an elastic contact plate structure of an electromagnetic relay, which is capable of greatly increasing the compression force and improving the stability of the contact between the fixed and movable contacts of the electromagnetic relay.

To achieve the aforementioned and other objectives, the present invention discloses an elastic contact plate structure of an electromagnetic relay, comprising: at least one elastic plate assembly, a first plate, having a first convex arc bent portion, and a first mounting hole formed at an end of the first plate; a second plate, stacked under the first plate, and fixed to the first plate, and the second plate having a second convex arc bent portion, and a second mounting hole formed at an end of the second plate and configured to be corresponsive to the first mounting hole; wherein the second convex arc bent portion is disposed under the first convex arc bent portion, and a gap is formed between the first and second convex arc bent portions; a third plate, stacked under the second plate and fixed to the second plate, and the third plate having a third mounting hole formed at an end of the third plate and configured to be corresponsive to the second mounting hole; and a fourth plate, stacked under the third plate, and having a fixed section and an elastic section, and the fixed section having a fourth mounting hole configured to be corresponsive to the third mounting hole, and the fourth plate having a plurality of grooves; wherein the fixed section is fixed to the third plate, and the elastic section is not fixed to the third plate; and at least one contact structure, passing and fixed into the first mounting hole, the second mounting hole, the third mounting hole and the fourth mounting hole. In this way, the elastic contact plate structure of the present invention can provide an appropriate structural force deformation to achieve the effects of providing a smooth operation in the limited space of the relay and improving the operation performance and reliability of the relay significantly.

DESCRIPTION OF THE EMBODIMENTS

Figure 1:
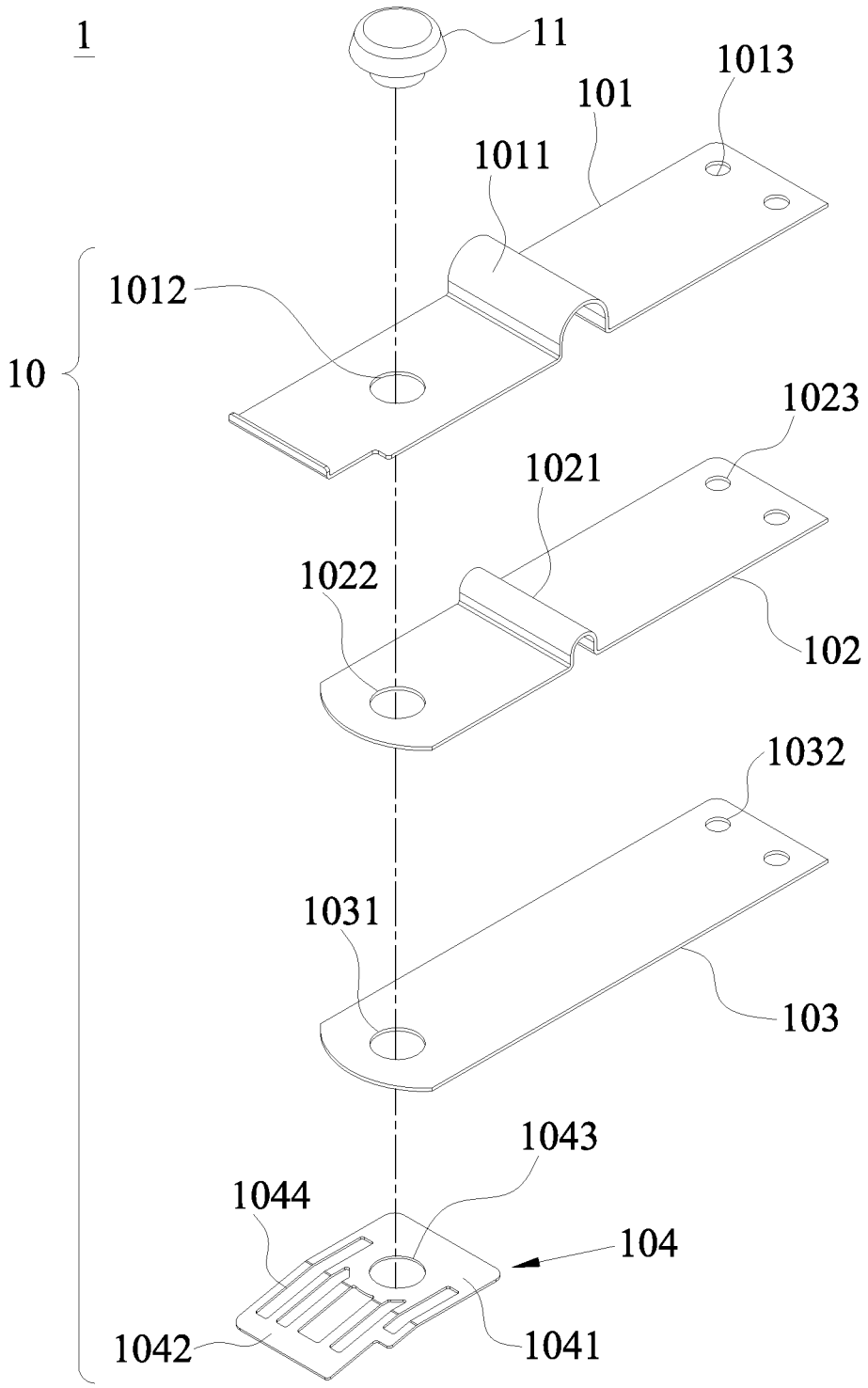
FIG. 1 is an exploded view of an embodiment of this invention.

The accompanying drawings are included to provide a further understanding of the disclosure, and are incorporated in and constitute a part of this specification. The drawings illustrate embodiments of the disclosure and, together with the description, serve to explain the principles of the disclosure.

With reference to FIGS. 1, 2A, 2B, 3 and 4 for the exploded view, the first and second schematic views of the assembly and the first and second schematic views of the application of an elastic contact plate structure in accordance with an embodiment of the present invention respectively, the elastic contact plate structure of electromagnetic relay 1 comprises: at least one elastic plate assembly 10 and at least one contact structure 11. The elastic plate assembly 10 comprises a first plate 101, a second plate 102, a third plate 103 and a fourth plate 104, and the first plate 101 has a first convex arc bent portion 1011 and a first mounting hole 1012 formed at an end of the first plate 101. The second plate 102 is stacked under the first plate 101 and fixed to the first plate 101, and the second plate 102 has a second convex arc bent portion 1021 and a second mounting hole 1022 formed at an end thereof and configured to be corresponsive to the first mounting hole 1012, wherein the second convex arc bent portion 1021 is disposed under the first convex arc bent portion 1011, and a gap is formed between the first and second convex arc bent portions 1011, 1021. The third plate 103 is stacked under the second plate 102 and fixed to the second plate 102, and an end of the third plate 103 has a third mounting hole 1031 configured to be corresponsive to the second mounting hole 1022. The fourth plate 104 is stacked under the third plate 103, and the fourth plate 104 has a fixed section 1041 and an elastic section 1042, and the fixed section 1041 has a fourth mounting hole 1043 configured to be corresponsive to the third mounting hole 1031, and the fourth plate 104 has a plurality of grooves 1044, wherein the fixed section 1041 and the third plate 103 are fixed to each other, but the elastic section 1042 and the third plate 103 are not fixed to each other. The contact structure 11 is passed and fixed to the first mounting hole 1012, the second mounting hole 1022, the third mounting hole 1031 and the fourth mounting hole 1043. Preferably, the first plate 101, the second plate 102 and the third plate 103 are made of copper, and the fourth plate 104 is made of stainless steel.

Therefore, the present invention can effectively adjust the elasticity of the elastic plate after being stressed, so that the elastic contact plate structure 1 has an appropriate relationship between stress and deformation, so as to achieve the effect of optimizing the contact and pressing force between the contact structure 11 of the elastic contact plate structure 1 and the other contact. With the aforementioned structural characteristics, the relationship between the stress and deformation of the elastic contact plate structure 1 shows a direct proportion between the applied force and the deformation. In other words, the larger the applied force, the larger the deformation. When the force applied becomes smaller, the elastic contact plate structure 1 resumes to its original position gradually, so that issue of unable to resume the position no longer exists, when a force is applied to the elastic contact plate structure to instantly deform the elastic contact structure. In this way, the stress received by the elastic contact plate structure and the deformation of the elastic contact plate structure show a substantially positive linear change with each other, which approaches the ideal relational status of the deformation of a stressed spring, and this characteristic can avoid the situation of a too-strong structural rigidity causing a very large applied force but having a slight deformation, so that the contact cannot smoothly touch the other contact and can overcome the issue that the elastic plate is deformed sharply in an instant and fails to be recovered anymore; or can avoid the situation of a too-small structural rigidity that causes an incomplete contact between the contact structure 11 and the other contact and leads to a high temperature operation and an unstable resistance. Therefore, the invention can increase the pressing force effectively in the limited space of the electromagnetic relay during the use of the elastic contact plate structure 1 to prevent overheat or too-large resistance change caused by the incomplete contact with the contact. Specifically, the fourth plate 104 of the elastic contact plate structure 1 has the fixed section 1041, the elastic section 1042 and the grooves 1044, and the fixed section 1041 is an area provided for fixing with the third plate 103, so that the elastic section 1042 and the grooves 1044 can provide elastic deformation during the use of the elastic contact plate structure 1 to increase the contact force of the contact structure 11 with the other contact and allow the relationship between force receiving strength and deformation of the elastic contact plate structure 1 to approach a positive linear change characteristic. Further, the formation of the grooves 1044 allows the fourth plate 104 to have a rib for uniformly distributing the received pressing force to the position of the contact structure 11, so as to achieve the effects of preventing warping or skewing occurred when a force is applied, and improving the stability of the contact between the contact structure 11 and the other contact.

Figure 3:
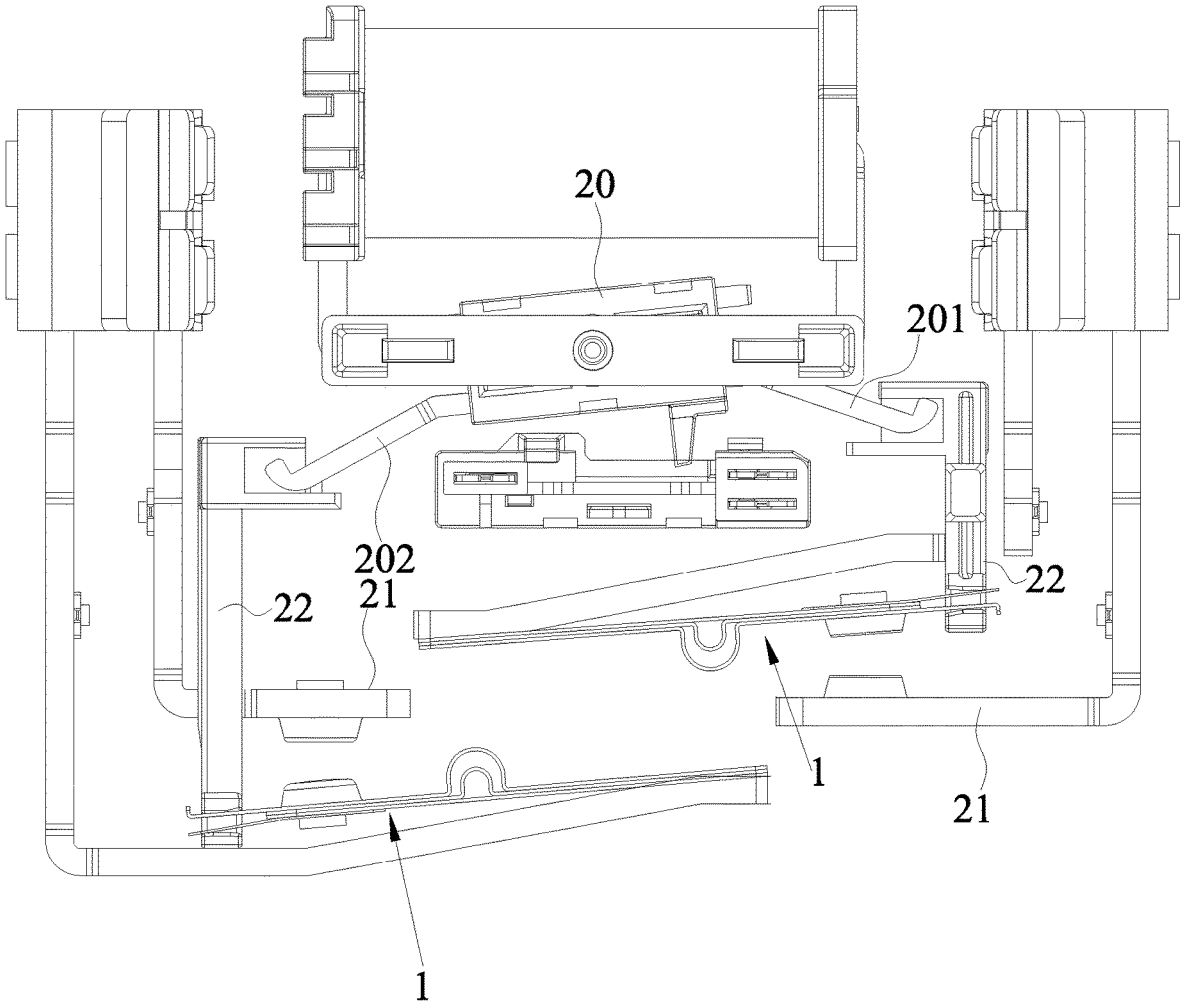
FIG. 3 is a first schematic view showing a first application of an elastic contact plate structure in accordance with an embodiment of the present invention.
Figure 4:
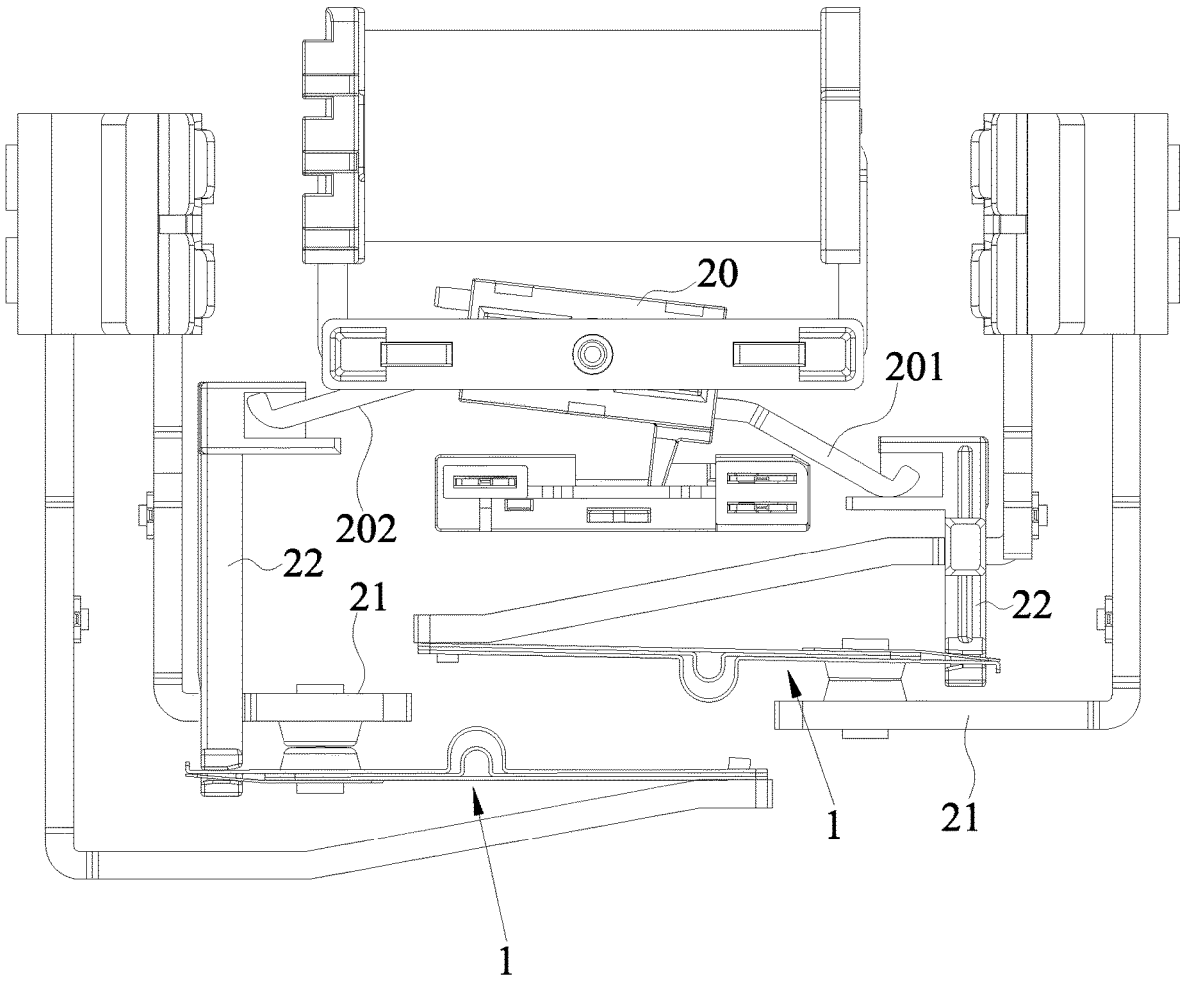
FIG. 4 is a second schematic view showing a first application of an elastic contact plate structure in accordance with an embodiment of the present invention.

The elastic contact plate structure 1 is applicable to various electromagnetic relays and used as a movable elastic plate, and the elastic contact plate structure is driven and displaced in response to the electromagnetic effect to touch or move away from the other contact, so as to achieve the effect of controlling the ON/OFF of the electromagnetic relay. In the electromagnetic relay, there may be one or more groups of the elastic contact plate structures 1. With reference to FIGS. 3 and 4 for the schematic views showing the internal structure of an elastic contact plate structure in accordance with an embodiment of the present invention, the electromagnetic relay of this embodiment has two groups of elastic contact plate structures 1. The electromagnetic relay includes a rotating bridge 20, two fixed contact plates 21 and two extension arms 22, and the rotating bridge 20 has a first rotating plate 201 and a second rotating plate 202 extending from both sides of the rotating bridge 20 respectively and provided for controlling the elastic contact plate structures 1, and the first rotating plate 201 is fixed to an end of any one of the extension arms 22, and any one of the elastic contact plate structures 1 is coupled to the other end of this extension arm 22; the second rotating plate 202 is fixed to the other extension arm 22, and the other elastic contact plate structure 1 is coupled to the other end of this extension arm 22. The fixed contact plates 21 are configured to be corresponsive to the elastic contact plate structures 1 respectively. When the rotating bridge 20 is moved by the electromagnetic effect, the contact structures 11 of the elastic contact plate structures 1 are driven synchronously to touch or separate from the contacts of the fixed contact plates 21, so as to control the electrical status of the electromagnetic relay.

Figure 5:
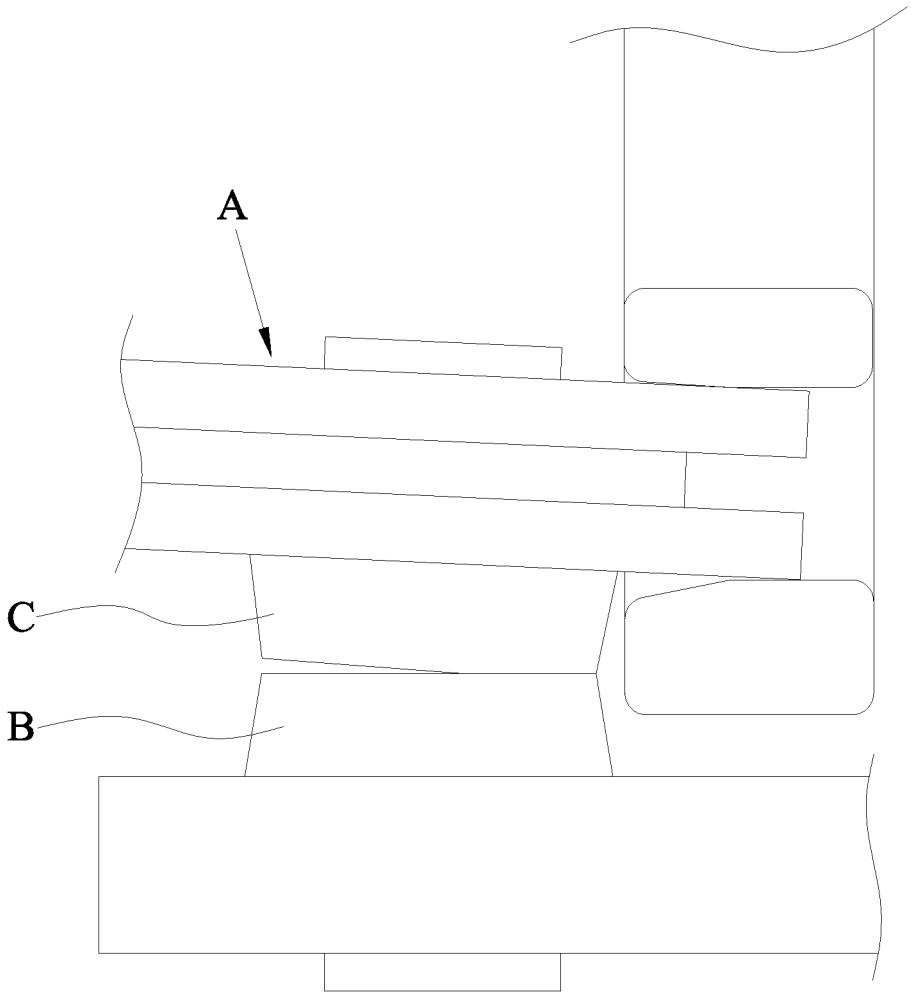
Fig. 5(PRIOR ART)
FIG. 5 is a schematic view showing a partial application of a conventional elastic contact plate structure.

With reference to FIG. 5 for the schematic view showing an application of a conventional elastic plate structure, the conventional elastic plate structure A is a three-plate structure as shown in the figure, and when a force is applied to the elastic plate structure A to touch a fixed contact B, the conventional elastic plate structure A does not have any structure for adjusting the elastic force exertion, so that it will be deformed or warped easily in an instant because the conventional elastic plate structure A is moved in a direction towards the fixed contact B. Instead, a contact C and the fixed contact B of the conventional elastic plate structure are in an incomplete contact, resulting in high temperature and unstable resistance as shown in FIG. 5. In the present invention, FIG. 3 shows the status of the elastic contact plate structures 1 which are not in contact with the contacts of the fixed contact plates 21, and FIG. 4 shows the status of the elastic contact plate structures 1 which are in contact with the contacts of the fixed contact plates 21 in response to the movement of the rotating bridge 20. By the structure of the fourth plate 104 of the elastic contact plate structures 1, the elastic contact plate structures 1 have a better elastic performance when receiving a force. Based on the design of the elastic section 1042 and the fixed section 1041, the force can be transmitted to an area having the contact structures 11, so as to achieve the effects of touching the contact of the fixed contact plate 21 while preventing the elastic contact plate structures from producing a warpage that leads to an incomplete contact, and allowing the contact structures 11 to have a stable contact with the contact of the fixed contact plates 21. Similarly, the fourth plate 104 has a structural design of the grooves 1044, a front rib, a middle rib and a rear rib formed between the grooves, so that the received pressing force can be distributed uniformly to the front of the contact structure 11, the periphery of the contact structure 11, and the rear of the contact structure 11 to prevent warping or skewing, so as to improve the stability of the contact of the contact structure 11 with the other contact.

Figure 2A:
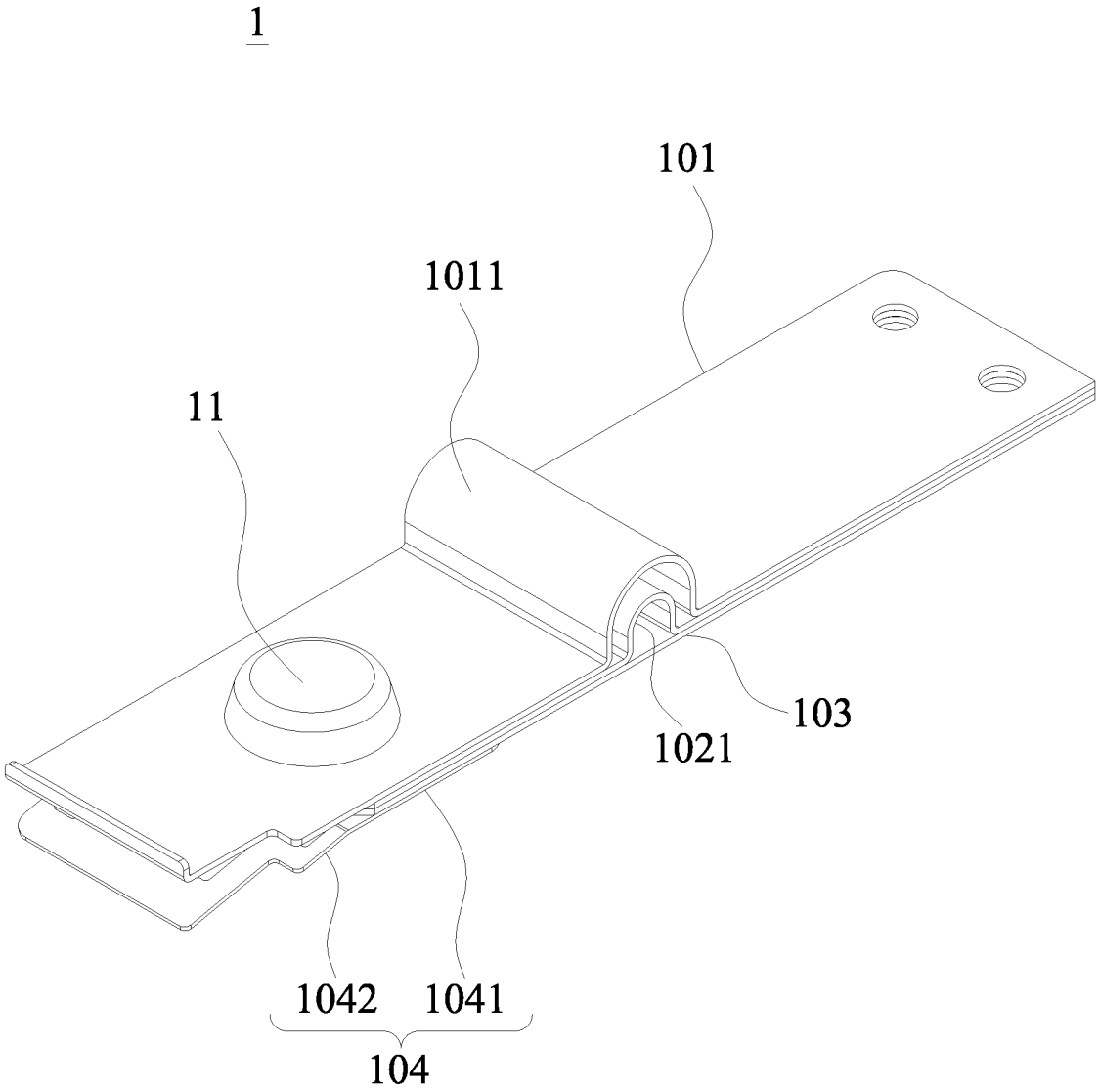
FIG. 2A is a perspective view showing the assembly of an elastic contact plate structure in accordance with an embodiment of the present invention.
Figure 2B:
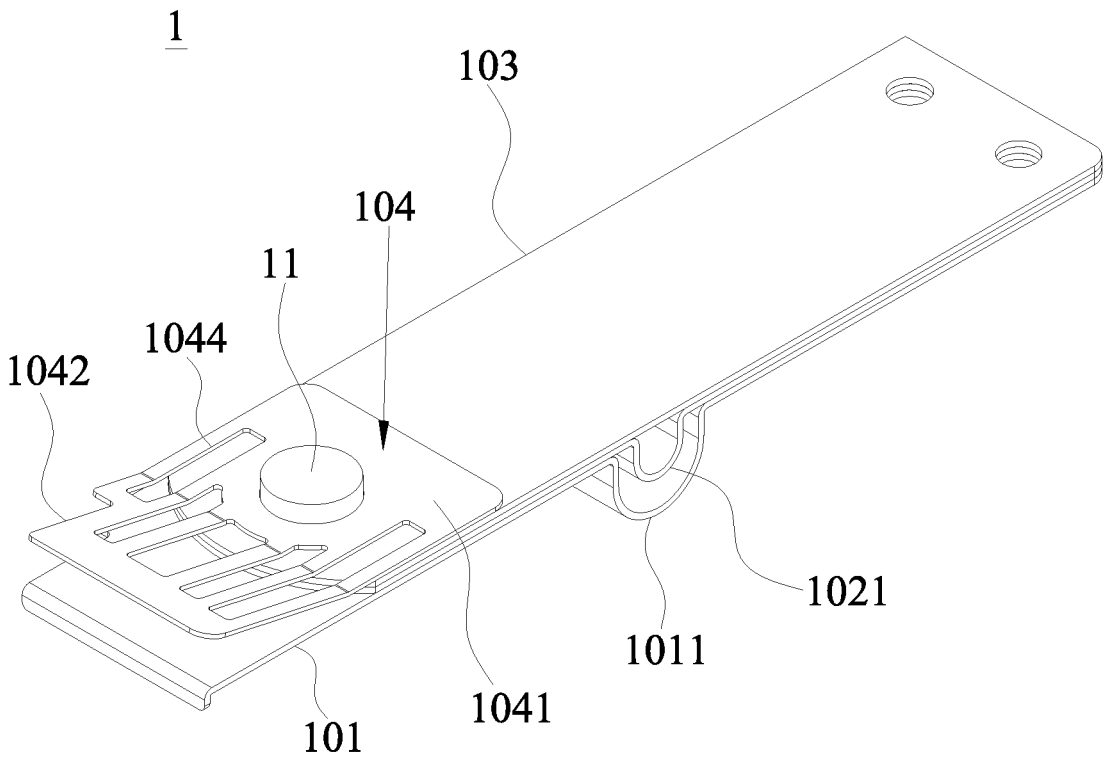
FIG. 2B is another perspective view showing the assembly of an elastic contact plate structure in accordance with an embodiment of the present invention, viewing from another angle.

In an implementation mode, the grooves 1044 formed on the fourth plate 104 are in a long-strip shape, and the extension directions of the grooves 1044 are parallel to one another, so that the elastic contact plate structure 1 can be maintained at an appropriate application presentation to improve the stability of operation. Further, the grooves 1044 are arranged by using the periphery of the fourth mounting hole 1043 as a starting point and radiating in a direction towards the elastic section 1042, so that the grooves 1044 will not be distributed beyond the fourth mounting hole 1043 to prevent affecting the operation of the contact structure 11, while ensuring the rigidity of the fourth plate 104, since a too-soft fourth plate 104 will be deformed easily and may lead to a poor contact of the contact structure 11. If the quantity of the grooves 1044 is an odd number, the groove 1044 at the middle position has an aperture area greater than the aperture area of each of the grooves 1044 on both sides, so that the fourth plate 104 has a more uniform and symmetrical force receiving condition to provide a better performance for the application when the elastic contact plate structure 1 is pressed and deformed. In this embodiment, there are five grooves 1044 with the overall rigidity and deformation elasticity of the plate. In FIG. 1 or 2B, the fourth plate 104 have five grooves 1044, and the groove 1044 at the middle position has an aperture area greater than the aperture area of each of the remaining grooves 1044 on both side. In the meantime, the grooves 1044 are in a long-strip shape and parallel to each other, and the ends of the grooves 1044 do not exceed the fourth mounting hole 1043, and such arrangement can avoid affecting the operation of the contact structure 11.

In addition, in another implementation mode, an end of at least one groove 1044 near the fourth mounting hole 1043 is tilted or curved relative to the periphery of the fourth mounting hole 1043 in order to keep a certain distance between the fourth mounting hole 1043 and the contact structure 11, and the edge of the tilted or curved structure allows the deformation caused by the received force can meet the requirement of the application.

To facilitate the elastic contact plate structure 1 to be fixed into electromagnetic relay, the first plate 101 preferably has at least one first assembly hole 1013 formed at the other end of the first mounting hole 1012, and the second plate 102 preferably has at least one second assembly hole 1023 formed at the other end of the second mounting hole 1022, and the third plate 103 preferably has at least one third assembly hole 1032 formed at the other end of the third mounting hole 1031, and the first assembly hole 1013, the second assembly hole 1023 and the third assembly hole 1032 are communicated with one another, such that the ends of the first assembly hole 1013, the second assembly hole 1023 and the third assembly hole 1032 of the elastic contact plate structure 1 are fixed and electrically conducted with the terminal circuit of the electromagnetic relay. Meanwhile, the elastic contact plate structure 1 has an end of the contact structure 11 that can be driven and displaced.

Figure 6:
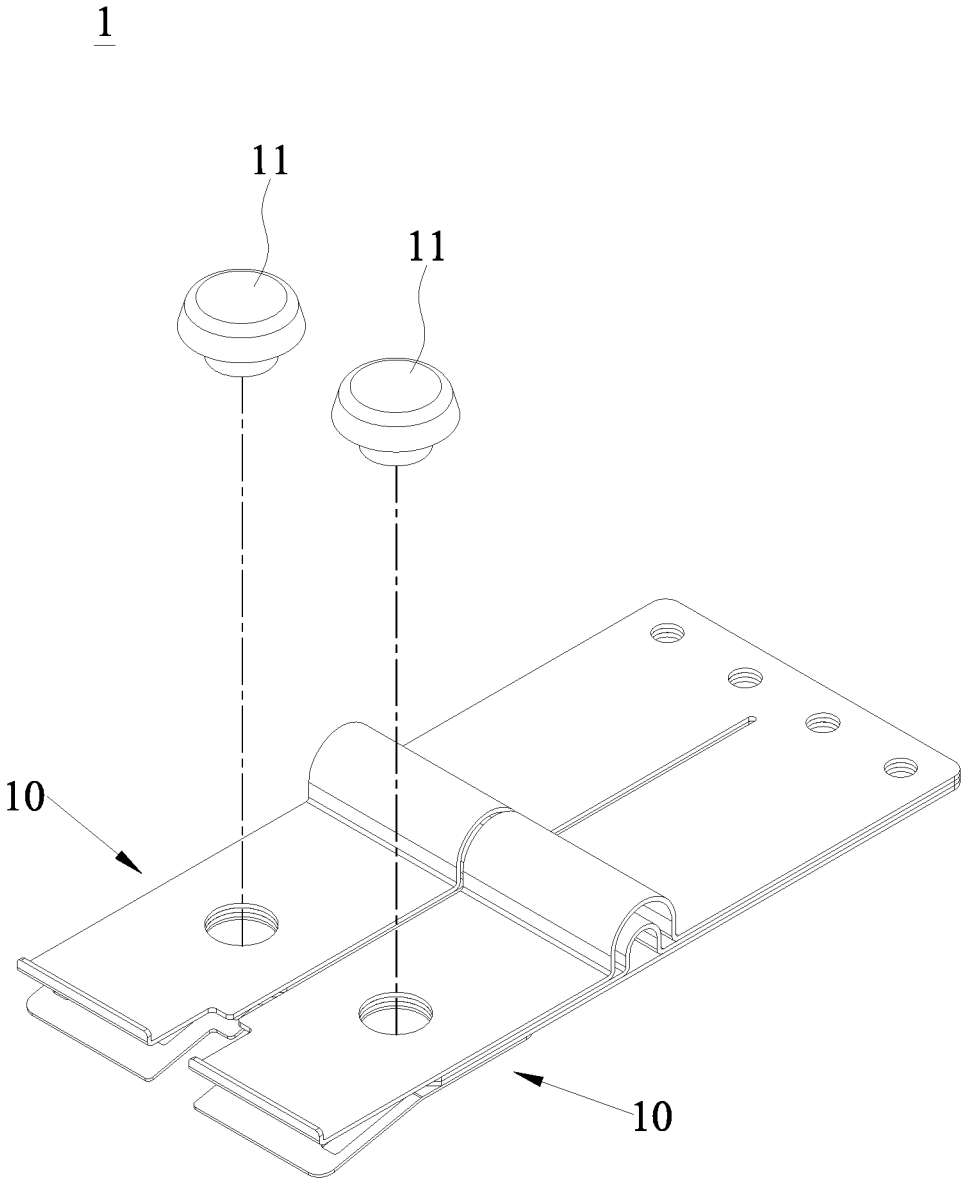
FIG. 6 is a schematic view showing a partial application of an elastic contact plate structure in accordance with another implementation mode of an embodiment of the present invention.
Figure 7:
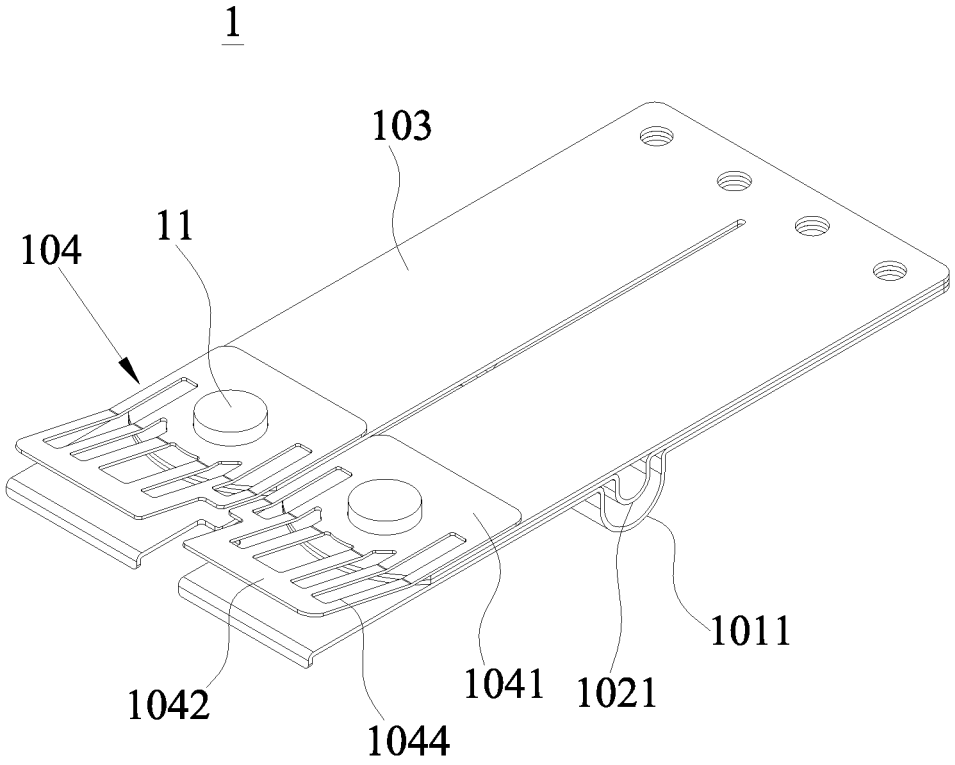
FIG. 7 is a perspective view showing the assembly of an elastic contact plate structure in accordance with another implementation mode of an embodiment of the present invention.

In FIGS. 3, 4, 6 and 7, FIGS. 6 and 7 are the exploded view of an elastic contact plate structure and the schematic view of the assembly of the elastic contact plate structure in accordance with another implementation mode of an embodiment of the present invention respectively, there are two elastic plate assemblies 10 of the elastic contact plate structure 1, and the two elastic plate assemblies 10 are spaced apart and configured to be parallel to each other, and fixed to the other ends of the two elastic plate assemblies 10 without the contact structure 11. In addition to the single-contact structural form of the elastic contact plate structure 1, the elastic contact plate structure 1 can also be designed with a double-contact structural form as shown in FIGS. 6 and 7, so that the elastic contact plate structure 1 is applicable for a double-contact electromagnetic relay. The two elastic plate assemblies 10 have the gap formed therebetween to avoid mutual contact that may affect electrical conductions. Refer to FIG. 1 for the detailed structure of the single-contact elastic plate assembly 10.

Further, a side edge of each elastic plate assembly 10 having an end of the contact structure 11 can be in a tapered ladder form to prevent the two elastic plate assemblies 10 from being too near that may lead to the occurrence of various poor electrical conductions. With reference to FIGS. 6 and 7, the aforementioned tapered ladder structural form allows the elastic plate assemblies 10 proximate to an end of the contact structure 11 to have a larger gap to avoid mutual interference.

Similarly, if there are two elastic plate assemblies 10, each of the aforementioned technical characteristics can be applied in this case. For example, each of the grooves 1044 formed on the fourth plate 104 of each elastic plate assembly 10 is in a long-strip shape, and the extension directions of the grooves 1044 are parallel to one another; the grooves 1044 can also be extended from the periphery of the fourth mounting hole 1043 as a starting point towards the elastic section 1042. If the quantity of the grooves 1044 is an odd number, the groove 1044 at the middle position has an aperture area greater than the aperture area of each of the grooves 1044 on both sides, and the quantity of the grooves 1044 of this embodiment is equal to five, and at least one of the grooves 1044 proximate to an end of the fourth mounting hole 1043 is tilted or curved with respect to the periphery of the fourth mounting hole 1043. Relevant detailed description and corresponding effects have been described above, and will not be repeated.

In applications as shown in FIGS. 3 and 4, the structural status of the double-contact elastic plate assembly 10 is the same as that of the single-contact elastic plate assembly 10, and the elastic contact plate structure 1 having two elastic plate assemblies 10 is installed in an electromagnetic relay, and can also have one or more groups, and each of the elastic contact plate structures 1 is driven by the first rotating plate 201 and the second rotating plate 202 of the rotating bridge 20 through the structure of the extension arms 22, so that the two contact structures 11 of each elastic contact plate structure 1 can touch or separate from the contact of the fixed contact plate 21. Relevant details of the operation have been described above, and thus will not be repeated.

Figure 8:
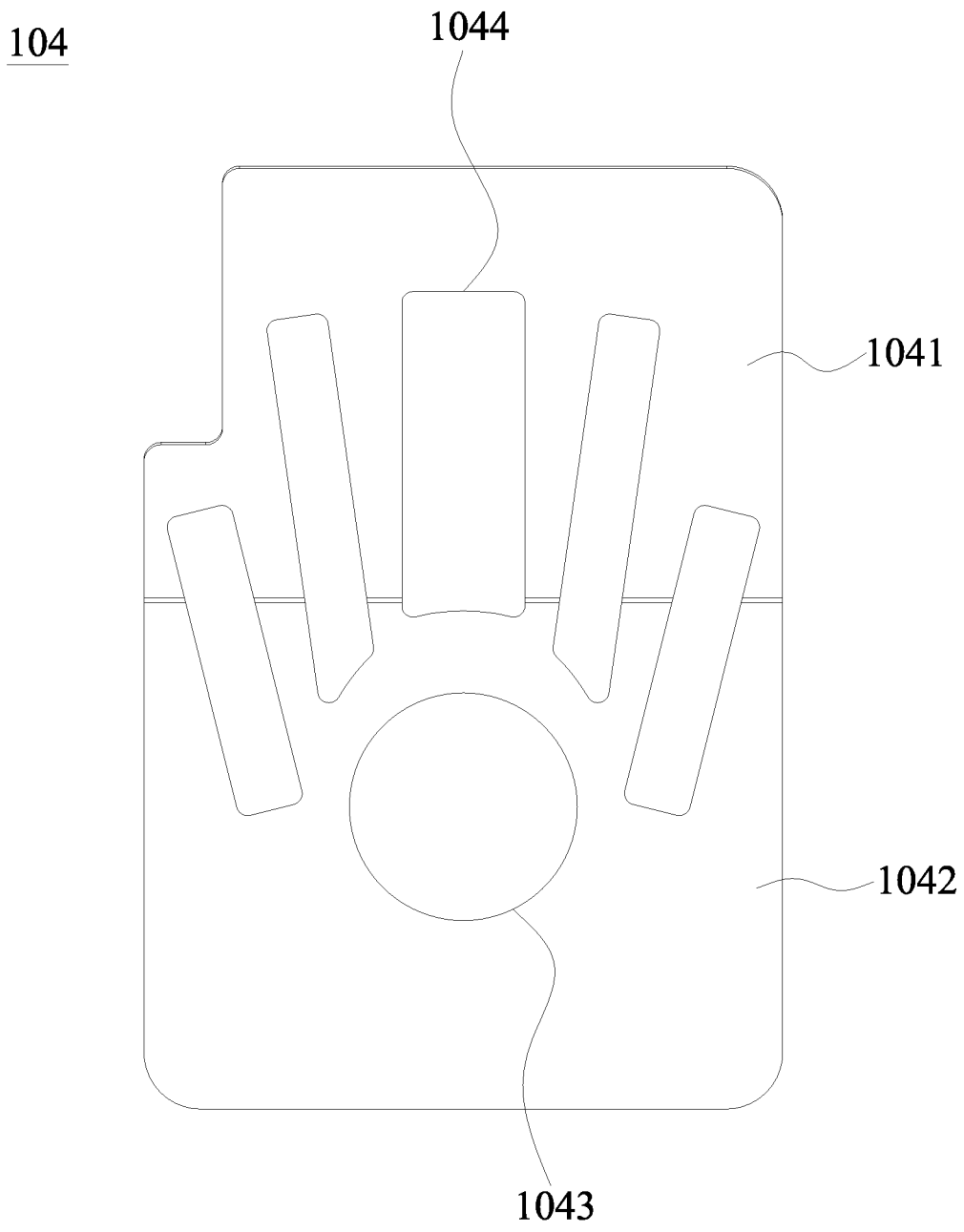
FIG. 8 is a schematic view of a fourth plate structure in accordance with another implementation mode of an embodiment of the present invention.

With reference to FIG. 8 for the schematic view showing the structure of the fourth plate in accordance to another implementation mode of an embodiment of the present invention, the grooves 1044 of the fourth plate 104 may be parallel long-strip structures as described above, or may be configured to be a radiating form that radiates from the periphery of the fourth mounting hole 1043 as a starting point towards the elastic section 1042 as shown in FIG. 8. In this way, the elastic contact plate structure 1 can also have a better deformation status to prevent a too-high rigidity that may affect the operation of the contact structure 11.

In summation of the description above, the elastic contact plate structure 1 of the present invention bases on the aforementioned technical characteristics to effectively improve the force receiving performance of the elastic plate and let the relationship between the force receiving strength and the deformation of the elastic contact plate structure 1 approach the ideal status of the positive linearity, so as to achieve the effects of improving the pressing force when touching the contact in the limited space of the electromagnetic relay, eliminating an excessive change of resistance, stabilizing the conductive circuit, while providing a better smoothness of operation. Specifically, the configuration of the fourth plate 104 and its elastic section 1042, fixed section 1041 and groove 1044 provides a smoother displacement during the operation, and increasing the pressing force when the contact structure 11 touches the other contact of the relay. Relatively, such arrangement can also increase the durability and the frequency of switching the contacts. Further, the present invention takes each element into consideration for practical operations and provides a detailed configuration of the grooves formed on the fourth plate 104, so that the fourth plate 104 can effectively achieve the aforementioned effects. The invention also takes the rigidity and the required flexible change into account.

What is claimed is:

1. An electromagnetic relay of an elastic contact plate structure of electromagnetic relay, comprising:

at least one elastic plate assembly, comprising:

a first plate, having a first convex arc bent portion, and a first mounting hole formed at an end of the first plate;

a second plate, stacked under the first plate, and fixed to the first plate, and the second plate having a second convex arc bent portion, and a second mounting hole formed at an end of the second plate and configured to be corresponsive to the first mounting hole; wherein the second convex arc bent portion is disposed under the first convex arc bent portion, and a gap is formed between the first convex arc bent portion and the second convex arc bent portions;

a third plate, stacked under the second plate and fixed to the second plate, and the third plate having a third mounting hole formed at an end of the third plate and configured to be corresponsive to the second mounting hole; and a fourth plate, stacked under the third plate, and having a fixed section and an elastic section, and the fixed section having a fourth mounting hole configured to be corresponsive to the third mounting hole, and the fourth plate having a plurality of grooves; wherein the fixed section is fixed to the third plate, and the elastic section is not fixed to the third plate; and at least one contact structure, passing and fixed into the first mounting hole, the second mounting hole, the third mounting hole and the fourth mounting hole.

2. The elastic contact plate structure as claimed in claim 1, wherein the first plate has at least one first assembly hole formed at the other end of the first mounting hole, and the second plate has at least one second assembly hole formed at the other end of the second mounting hole, and the third plate has at least one third assembly hole formed at the other end of the third mounting hole, and the at least one first assembly hole, the at least one second assembly hole and the at least one third assembly hole are configured to be corresponsive to and communicating with one another.

3. The elastic contact plate structure as claimed in claim 2, wherein the elastic plate assembly comes with a quantity of two, and the two elastic plate assemblies are spaced apart and parallel to each other, and the other ends of the two elastic plate assemblies without the contact structure are fixed to each other.

4. The elastic contact plate structure as claimed in claim 3, wherein a side edge of the end of the elastic plate assembly having the contact structure is in a tapered ladder shape.

5. The elastic contact plate structure as claimed in claim 1, wherein the grooves are in a long strip shape, and the grooves extend in an extension direction parallel to one another.

6. The elastic contact plate structure as claimed in claim 5, wherein the first plate has at least one first assembly hole formed at the other end of the first mounting hole, and the second plate has at least one second assembly hole formed at the other end of the second mounting hole, and the third plate has at least one third assembly hole formed at the other end of the third mounting hole, and the at least one first assembly hole, the at least one second assembly hole and the at least one third assembly hole are configured to be corresponsive to and communicating with one another.

7. The elastic contact plate structure as claimed in claim 6, wherein the elastic plate assembly comes with a quantity of two, and the two elastic plate assemblies are spaced apart and parallel to each other, and the other ends of the two elastic plate assemblies without the contact structure are fixed to each other.

8. The elastic contact plate structure as claimed in claim 7, wherein a side edge of the end of the elastic plate assembly having the contact structure is in a tapered ladder shape.

9. The elastic contact plate structure as claimed in claim 5, wherein the grooves are configured to be extending in a direction towards the elastic section by using the periphery of the fourth mounting hole as a starting point.

10. The elastic contact plate structure as claimed in claim 9, wherein the first plate has at least one first assembly hole formed at the other end of the first mounting hole, and the second plate has at least one second assembly hole formed at the other end of the second mounting hole, and the third plate has at least one third assembly hole formed at the other end of the third mounting hole, and the at least one first assembly hole, the at least one second assembly hole and the at least one third assembly hole are configured to be corresponsive to and communicating with one another.

11. The elastic contact plate structure as claimed in claim 10, wherein the elastic plate assembly comes with a quantity of two, and the two elastic plate assemblies are spaced apart and parallel to each other, and the other ends of the two elastic plate assemblies without the contact structure are fixed to each other.

12. The elastic contact plate structure as claimed in claim 11, wherein a side edge of the end of the elastic plate assembly having the contact structure is in a tapered ladder shape.

13. The elastic contact plate structure as claimed in claim 9, wherein if the quantity of the grooves is an odd number, aperture area of the groove situated at the middle position is greater than each of aperture area of the grooves on both sides of the middle position.

14. The elastic contact plate structure as claimed in claim 13, wherein the first plate has at least one first assembly hole formed at the other end of the first mounting hole, and the second plate has at least one second assembly hole formed at the other end of the second mounting hole, and the third plate has at least one third assembly hole formed at the other end of the third mounting hole, and the at least one first assembly hole, the at least one second assembly hole and the at least one third assembly hole are configured to be corresponsive to and communicating with one another.

15. The elastic contact plate structure as claimed in claim 14, wherein the elastic plate assembly comes with a quantity of two, and the two elastic plate assemblies are spaced apart and parallel to each other, and the other ends of the two elastic plate assemblies without the contact structure are fixed to each other.

16. The elastic contact plate structure as claimed in claim 15, wherein a side edge of the end of the elastic plate assembly having the contact structure is in a tapered ladder shape.

17. The elastic contact plate structure as claimed in claim 9, wherein the grooves come with a quantity of five.

18. The elastic contact plate structure as claimed in claim 1, wherein the grooves are configured to be extending radially towards the elastic section by using the periphery of the fourth mounting hole as a starting point.

19. The elastic contact plate structure as claimed in claim 1, wherein at least one of the grooves proximate to an end of the fourth mounting hole is configured to be corresponsive to the periphery of the fourth mounting hole and substantially in an oblique or arc shape.

* * * * *